United States Patent [19]

Bijma et al.

[11] Patent Number: 4,890,032

[45] Date of Patent: Dec. 26, 1989

[54] COLOR DISPLAY TUBE HAVING ELECTRODE CONVERGING MEANS

[75] Inventors: Jan Bijma; Antonius J. M. Van Den Beld, both of Eindhoven, Netherlands

[73] Assignee: U.S. Philips Corporation, New York, N.Y.

[21] Appl. No.: 251,068

[22] Filed: Sep. 27, 1988

Related U.S. Application Data

[63] Continuation of Ser. No. 370,430, Apr. 21, 1982, abandoned.

[30] Foreign Application Priority Data

May 22, 1981 [NL] Netherlands ..... 8102526

[51] Int. Cl.[4] ..... H01J 29/51; H01J 29/54; H01J 29/62; H01J 29/70

[52] U.S. Cl. ..... 313/412; 313/413; 313/414; 313/428; 313/447

[58] Field of Search ..... 313/412, 413, 414, 425, 313/428, 447, 449, 452, 409

[56] References Cited

U.S. PATENT DOCUMENTS

| | | | |
|---|---|---|---|
| 2,957,106 | 10/1960 | Moodey | 313/414 X |
| 3,628,077 | 12/1971 | Bossers | 313/447 |
| 3,875,446 | 4/1975 | Miyaoka | 313/414 |
| 3,919,583 | 11/1975 | Hasker et al. | 313/414 X |
| 4,234,814 | 11/1980 | Chen et al. | 313/414 X |
| 4,291,251 | 9/1981 | Bijma et al. | 313/412 X |
| 4,337,409 | 6/1982 | van der Heijen et al. | 313/414 X |

*Primary Examiner*—Kenneth Wieder
*Attorney, Agent, or Firm*—Robert J. Kraus

[57] ABSTRACT

A color display tube having an electron gun system for producing three in-line electron beams. The system includes, in the direction of travel of the beams, a first electrode, a second electrode and a plurality of focusing electrodes, each having apertures for passing the beams. The second electrode includes two spaced-apart plate-shaped members, each having a central and two outer apertures for passing the beams. The apertures in the members for each outer beam are laterally shifted with respect to each other and with respect to a corresponding aperture in the first electrode to direct the outer beams toward convergence with the inner beam.

7 Claims, 3 Drawing Sheets

COLOR DISPLAY TUBE HAVING ELECTRODE CONVERGING MEANS

This is a continuation of application Ser. No. 370,430, filed Apr. 21, 1982, now abandoned.

BACKGROUND OF THE INVENTION

The invention relates to a colour display tube comprising in an evacuated envelope a display screen and an electron gun system which comprises first means to generate three in-line electron beams. The first means comprise, for each electron beam, a cathode and a first and second electrode having apertures for each electron beam and being common for the three electron beams. The system further comprises second means to generate focusing lens fields for symmetrically focusing the electron beams on the display screen. The second means comprise at least two electrodes having apertures for each electron beam and being common for the three electron beams. The electron gun system produces asymmetric lens fields for the two outermost electron beams to deflect the two outermost electron beams toward the central electron beam to converge the electron beams on the display screen.

Such a colour display tube having a so-called integrated electron gun system in which a number of electrodes is constructed so as to be common for the electron beams is known from Netherlands patent application No. 7809160, corresponding to U.S. Pat. No. 4,291,251. In the embodiment shown in FIG. 6 of the above-mentioned patent application, the electron gun system comprises three cathodes, a common first and a common second electrode, with which three in-line electron beams are generated. Each of the electron beams is focused on the display screen by means of one single focusing lens field which is generated between the facing sides of a first and a second common focusing electrode.

In the first focusing electrode, the apertures for the two outermost electron beams on the side facing the second electrode are placed eccentrically with respect to the axes of the generated electron beams. As a result of this, an asymmetric lens field is formed between the facing sides of the first focusing electrode and the second electrode, which field deflects the two outermost electron beams in the direction of the central electron beam in such manner that the three electron beams converge on the display screen. The apertures in the two focusing electrodes at the area of the focusing lenses are staggered with respect to each other for the outermost two electron beams in such manner that symmetrical focusing lens fields are formed with respect to the outermost electron beams already deflected over the convergence angle. This has for its object that changes in the voltages of the focusing electrodes, and hence changes in the strength of the focusing lens fields, have no influence on the convergence of the electron beams.

Convergence of the electron beams independent of the focusing is of particular importance in those systems in which defects in static convergence are corrected by means of a ring of magnetic material placed in the neck of the display tube, which ring is permanently magnetized as a multipole from outside the tube dependent on the desired corrections. In such systems it is not possible to readjust the convergence of the electron beams from outside the tube to compensate for variations of the focusing voltages.

In the known tube convergence is effected by deflecting the two outermost electron beams toward the central electron beam near the apertures on the side of the first focusing electrode facing the second electrode. Deflecting the outermost electron beam in this spot has the disadvantage that variation in the voltages of the first focusing electrode and the second electrode cause small changes in the angle over which the outermost electron beams are deflected.

The changes in angle cause changes in the place of the virtual object which is displayed on the display screen by the focusing lens. These displacements result in beam displacements on the display screen and consequently convergence errors.

SUMMARY OF THE INVENTION

It is therefore the object of the invention to provide a tube having a system of electron guns in which convergence of the electron beams is independent of focusing.

For that purpose, according to the invention, a colour display tube of a kind mentioned in the opening paragraph is characterized in that the asymmetric lens field for deflecting the two outermost electron beams toward the central electron beam is generated substantially at the area of the cross-over of the two outermost electron beams. The invention is based on the following recognition. In the generated electron beams a so-called cross-over is formed at the area of the second electrode. The cross-over is the point in which an electron beam has its smallest cross-section. This cross-over is the object which is displayed on the display screen by the focusing lens. By deflecting the outermost electron beams over the convergence angle at the area of the cross-over, variations of the potential of the second electrode and the first focusing electrode do not result in variations in place of the beams on the display screen. In fact, the object point is always displayed sharply on the display screen so that variations in angle cause only a variation of the angle at which the beam impinges on the same place on the display screen.

A first embodiment of a second electrode with which the two outermost electron beams are deflected substantially at the area of the cross-over is characterized in that the second electrode is formed by a beaker-shaped electrode which in its bottom portion has apertures which are situated centrally with respect to the apertures in the first electrode, in which beaker-shaped electrodes on the bottom portion a first plate having apertures is connected, which apertures for the two outermost electron beams are situated eccentrically with respect to the apertures for the two outermost electron beams in the bottom portion, and in that at the open end of the beaker-shaped electrode a second apertured plate is connected whose apertures for the two outermost electrode beams are situated eccentrically with respect to the apertures for the outermost electron beams in the bottom portion of the beaker-shaped electrode.

A second embodiment of a second electrode with which the two outermost electron beams are deflected substantially at the area of the cross-over is characterized in that the second electrode is formed by a beaker-shaped electrode which is provided in the bottom portion with apertures which for the two outermost electron beams are situated eccentrically with respect to the apertures for the two outermost electron beams in the first electrode, and in that at the open end of the beaker-shaped electrode an apertured plate is connected whose apertures for the two outermost electron beams are situated eccentrically with respect to the apertures for the outermost electron beams in the first electrode.

In addition to electron gun systems in which the electron beams are focused on the display screen by means of one focusing lens, electron gun systems are known in which the electron beams are displayed on the display screen by means of several focusing lenses.

U.S. Pat. No. 4,063,340, for example, discloses an integrated system of electron guns having four focusing electrodes with which three focusing lens fields are generated. The focusing electrode which is last taken in the forward direction of the electron beams is at a high voltage potential, the first and third focusing electrodes are interconnected electrically and are at a potential which is approximately 40% of the high voltage potential and the second focusing electrode is at a potential which is approximately 25% of the high voltage potential.

Furthermore, U.S. Pat. No. 3,863,091 discloses a system of electron guns having four focusing electrodes in which the second and fourth focusing electrodes are interconnected electrically and are at a high voltage potential and the first and third focusing electrodes are interconnected electrically and are at a potential which is approximately 40% of the high voltage potential.

An electron gun system of the so-called unipotential type having three focusing electrodes of which the first and third focusing electrodes are interconnected electrically and are at a high voltage potential is disclosed in U.S. Pat. No. 4,178,532.

In such systems of electron guns constructed with several focusing lenses it is also desirable for the convergence of the electron beams to be independent of the focusing of the electron beams.

For that purpose, a further embodiment is characterized in that the second means comprise at least three electrodes having apertures for the two outermost electron beams the centres of which are situated substantially on the axis of the outermost electron beams deflected substantially at the area of the cross-over. After the two outermost electron beams having been deflected over the convergence angle substantially at the area of the cross-over, all focusing lens fields should focus the already deflected outermost electron beams without further deflecting them. After traversing each focusing lens field, the axis of an electron beam should be situated in the elongation of the axis of the electron beam prior to traversing the focusing lens field. This is effected in that the centres of all apertures for the outermost electron beams in the focusing electrodes are situated substantially on the axes of the outermost electron beams already deflected over the convergence angle at the area of the cross-over. As a result of this, all focusing lens fields for the two outermost electron beams are symmetrical with respect to the passing beam. In this case, a variation in the voltages of the focusing electrodes has no influence on the convergence of the electron beams.

Again a further embodiment is characterized in that the diameter of the apertures in the electrodes of the second means decreases from the focusing electrode, which is last taken in the forward direction of the electron beams, towards the first electrode. In the electron gun systems known from the above-mentioned U.S. Patent Specifications and having several focusing lenses, the successive apertures in the focusing electrodes have the same diameters. In an electron gun system in which the centres of the apertures for the outermost electron beams in the focusing electrodes are situated substantially on the axis of the outermost electron beams already deflected at the area of the cross-over, equal diameters of the apertures in the focusing electrodes would mean an increase of the cross-section of the system electron gun system. This would prevent the use of the electron gun system in a display tube having a narrow neck diameter. By causing the lens diameter of the successive focusing lenses to decrease taken from the last focusing electrode, the cross-section of the system of electron guns can remain small. The smaller lens diameter of the focusing electrodes preceding the last focusing electrode, do not result in an increase of the spherical aberration of the electron beams since in a system having several focusing lenses the cross-section of the electron beam in the forward direction increases only slowly so that the diameter of the electron beam remains small with respect to the diameter of the focusing lenses.

BRIEF DESCRIPTION OF THE DRAWING

The invention will now be described in greater detail, by way of example, with reference to the accompanying drawing, in which.

DESCRIPTION OF THE PREFERRED EMBODIMENTS

Figure 1:
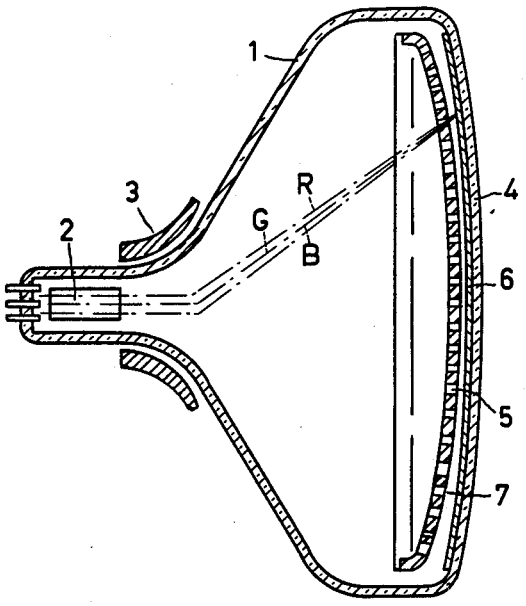
FIG. 1 is a sectional view of a colour display tube according to the invention.

The colour display tube according to the invention shown in FIG. 1 comprises in an evacuated envelope 1 an electron gun system 2 shown diagrammatically for generating three electron beams denoted by R, G and B. The three electron beams are deflected by means of a system of deflection coils 3 placed coaxially around the tube axis and they intersect each other at the area of a shadow mask 5 connected at a short distance from the display window 4. The display window 4 has a display screen 6 which is formed by a pattern of phosphors luminescing in the colours red, green and blue. The shadow mask 5 has a large number of apertures 7 and is positioned with respect to the display screen 6 in such manner that each of the electron beams is associated with phosphor regions of one colour.

Figure 2:
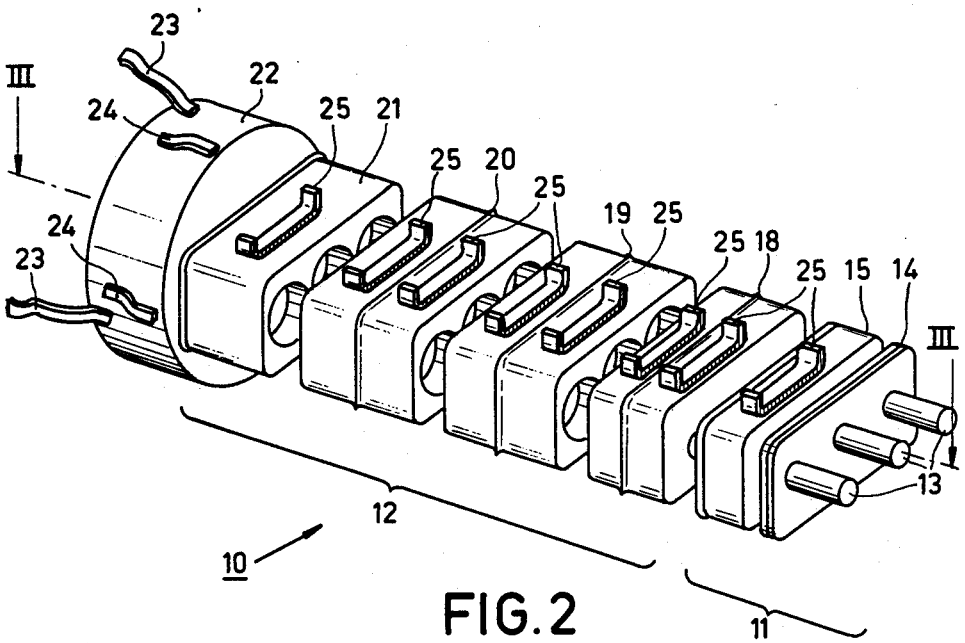
FIG. 2 is a perspective illustration of a first embodiment of an electron gun system for the tube shown in FIG. 1.

FIG. 2 shows diagrammatically an embodiment of an electron gun system for a display tube according to the invention. The electron gun system 10 comprises first means 11 to generate three electron beams situated in one plane. The means 11 comprise three separate cathodes 13, a common first electrode 14 and a common second electrode 15 which have apertures for the three electron beams. The means 12 are formed by four focusing electrodes 18, 19, 20 and 21 which are common for the three electron beams. The electrodes 18, 19 and 20 are each formed by two beaker-shaped portions engaging each other with their open ends. A centring cup 22 having contact springs 23 and centring springs 24 is connected to the electrode 21. The contact springs 23 make electrical contact with an electrically conductive layer provided internally on the tube wall. The centring springs 24 position the system of electron guns 10 in the neck of the display tube. The electrodes have suspension braces 25 the ends of which are sealed in insulating glass rods which are not shown to avoid complexity of the drawing.

During operation of the tube the electrodes of the electron gun system 10 carry, for example, the following potentials

| | |
|---|---|
| cathode 13 | 0–160 V |
| first electrode 14 | 0 V |
| second electrode 15 | 700 V |
| electrode 18 | 10 kV |
| electrode 19 | 25 kV |
| electrode 20 | 10 kV |
| electrode 21 | 25 kV |

Figure 3:
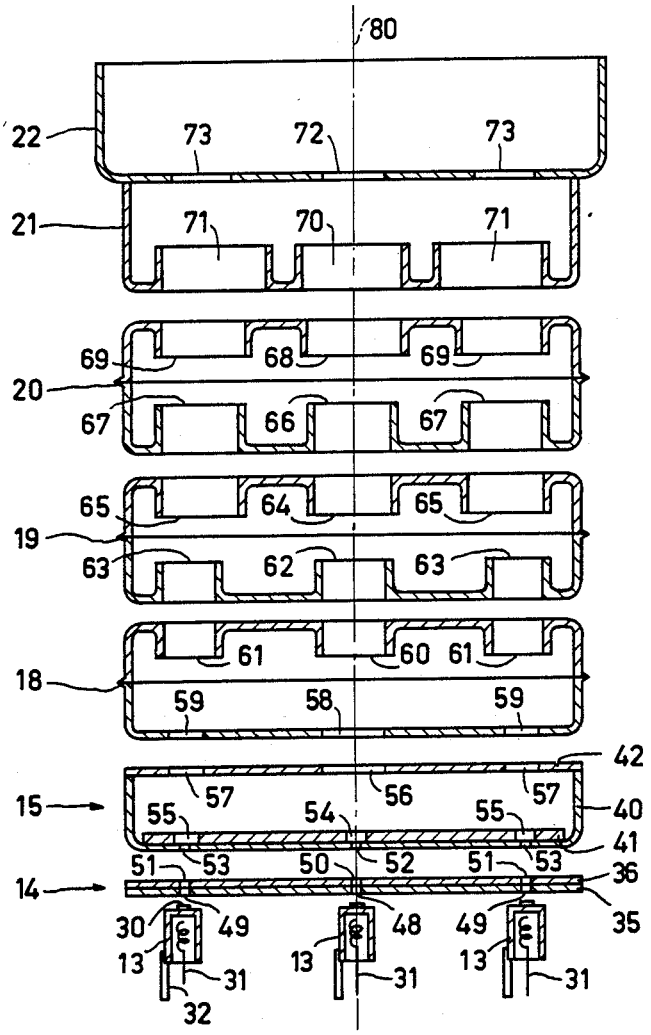
FIG. 3 is a sectional view of the electron gun system shown in FIG. 2, FIGS. 4*a* and 4*b* further explain the principle of the invention.

FIG. 3 is a diagrammatic longitudinal sectional view of the electron gun system shown in FIG. 2. The electron gun system comprises three cathodes 13 which are shown diagrammatically and the end faces of which are covered with an emissive layer 30. A filament 31 is accommodated inside each cathode. Each cathode 13 comprises a current supply conductor 32 to which the video signal for the beam in question is supplied. A first electrode 14 which is common for the three electron beams is provided at a distance of 0.75 mm from the cathodes 13. The first electrode 14 is constructed from two plates 35 and 36 which are provided against each other and have thicknesses of 0.1 mm and 0.2 mm, respectively.

A second electrode 15 is present at a distance of 0.25 mm from the first electrode 14. This second electrode 15 is formed by a beaker-shaped portion 40 in which an apertured plate 41 is connected on the apertured bottom portion. Another apertured plate 42 is connected at the open end of the beaker-shaped portion 40. The overall height of the second electrode 15 is 1.45 mm. In the table below the dimensions of the apertures in the first electrode 14 and the second electrode 15 with their distances to the axis 80 of the central electron beam are recorded. It is to be noted that in the case of different dimensions of the electrodes different dimensions of the apertures and different axial dimensions are necessary.

| electrode No. | Thickness (mm) | Aperture No. | Dimensions (mm) | Distance axis to axis 80 (mm) |
|---|---|---|---|---|
| 14–35 | 0.10 | 48 | 0.7 × 0.7 | — |
| | | 49 | 0.7 × 0.7 | 9.90 |
| –36 | 0.20 | 50 | 0.7 × 2.1 | — |
| | | 51 | 0.7 × 2.1 | 9.90 |
| 15–40 | 0.10 | 52 | ϕ 0.7 | — |
| | | 53 | ϕ 0.7 | 9.90 |
| –41 | 0.15 | 54 | ϕ 1.9 | — |
| | | 55 | ϕ 1.9 | 9.40 |
| –42 | 0.40 | 56 | ϕ 3.0 | — |
| | | 57 | ϕ 3.0 | 9.75 |

As appears from the above table, the apertures 55 in the plate 41 and the apertures 57 in the plate 42 for the two outermost electron beams are staggered with respect to the corresponding apertures 53 in the beaker-shaped portion 40. As a result of this an asymmetric lens field is formed at the area of the second electrode 15 for the outermost electron beams, which field deflects the outermost electron beams toward the central electron beam effecting convergence of the three electron beams on the display screen. Each of the outermost electron beams is deflected substantially at the area of cross-over. The cross-over occurs at the area of the second electrode 15, and is the place where the electron beam has its smallest cross-section. The advantage of deflecting the outermost electron beams over the convergence angle at the area of the cross-over is that voltage variations of the first focusing electrode 18 and the second electrode 15 have substantially no influence on the convergence of the electron beams. As a matter of fact the cross-over is the object which is displayed on the display screen by the focusing lenses. As a result of this, variations in the angle over which the outermost electron beams are deflected at the area of the cross-over as a result of voltage variations in the second electrode 15 and the first focusing electrode electrode 18 only cause variations in the angle at which the electron beams impinge on the display screen and not in the place where the electron beams impinge on the display screen.

After traversing the second electrode 15 in which the two outermost electron beams are deflected over the convergence angle, the electron beams are focused on the display screen by a number of successive focusing lens fields. The focusing lens fields are formed between the facing sides of the electrodes 18 and 19, 19 and 20 and 20 and 21. The lens field between the second electrode 15 and the electrode 18 ensures a so-called pre-focusing of the electron beams. The distance between the second electrode 15 and the first focusing electrode is 1.40 mm.

In the table below are recorded the diameters of the apertures in the focusing electrodes and the distances to the axis 80 of the central electron beam. The mutual distance between the focusing electrodes is 0.7 mm and the thickness of the electrode material is 0.2 mm.

TABLE II

| Electrode No. | Height (mm) | Aperture No. | Diameter (mm) | Distance axis to axis 80 (mm) |
|---|---|---|---|---|
| 18 | 9.0 | 58 | 3.30 | — |
| | | 59 | 3.30 | 9.85 |
| | | 60 | 5.45 | — |
| | | 61 | 5.45 | 9.56 |
| 19 | 11.0 | 62 | 5.57 | — |
| | | 63 | 5.57 | 9.62 |
| | | 64 | 6.37 | — |
| | | 65 | 6.37 | 9.21 |
| 20 | 11.0 | 66 | 6.51 | — |
| | | 67 | 6.51 | 9.28 |
| | | 68 | 7.34 | — |
| | | 69 | 7.34 | 8.87 |
| 21 | 9.9 | 70 | 7.50 | — |
| | | 71 | 7.50 | 8.95 |
| 22 | 13.0 | 72 | 4.50 | — |
| | | 73 | 4.50 | 8.70 |

As appears from the above table the apertures for the outermost electron beams are staggered relative to each other and the apertures have different diameters. As a result of this the focusing lens fields are formed which are symmetrical for the two outermost electron beams already deflected over the convergence angle. After traversing such a symmetrical focusing lens field the axis of an electron beam lies in the elongation of the axis of the electron beam prior to traversing the lens field. By the symmetrical focusing of the two outermost electron beams it is effected that the convergence of the electron beams is independent of the focusing of the electron beams. In fact, in the case of voltage variations of the focusing electrodes only the strength of the focusing of the electron beams varies without the convergence being influenced. A convergence of the electron beams which is independent of the focusing is of particular importance for those systems in which errors in the static convergence are corrected for by means of a ring of magnetic material which is placed in the neck of the display tube and which is permanently magnetized as a multipole from outside the tube dependent upon the desired corrections. In such systems it is not possible to readjust the convergence of the electron beams from outside the tube to compensate for variations in the focusing voltages.

It may also be read from the table that the diameters of the apertures in the focusing electrodes and hence the diameters of the focusing lenses decreases from electrode 21 in the direction towards the electrode 15. By causing the diameter of the successive focusing lenses to decrease in this direction, the cross-section of the electron gun system may remain restricted. In an electron gun system in which the centres of the apertures in the focusing electrodes for the outermost electron beams are situated substantially on the axes of the outermost electron beams already deflected at the area of the cross-over, equal diameters of the apertures in the focusing electrodes would mean an increase of the cross-section of the electron gun system. The smaller diameters of the focusing lenses preceding the last focusing lens do not result in an increase of the spherical aberration of the electron beams. In a system having several focusing lenses the cross-section of the electron beam in the forward direction increases only slowly. As a result of this the cross-section of the electron beam remains small with respect to the cross-section of the focusing lenses so that the spherical aberration also remains small.

As already mentioned, in an electron gun system the cross-over of a beam is displayed on the display screen by means of a lens system. In an electron gun system in which said system of lenses is formed by a number of focusing lens fields, a small increase of the beam cross-over occurs. The small increase gives a small spot of the electron beam in the centre of the display screen. However, a small increase is associated with a comparatively large increase of the angle. As a result of this, in such electron gun systems the cross-section of the electon beams in the deflection plane is comparatively large. In the deflection plane the beams are deflected over the display screen by means of a deflection coil placed around the display tube. The conventionally used deflection coils are self-converging, that is to say they need no dynamic convergence corrections. Such self-convergence deflection coils, however, are strongly astigmatic. As a result of this the spot of the electron beam upon deflection obtains a large vertical haze, which leads to a strong reduction of the sharpness at the edge of the display screen. This vertical haze is proportional to the vertical dimension of the cross-section of the electron beams in the deflection plane. Due to the large vertical dimensions in the deflection plane in an electron gun system having several focusing lenses a comparatively large vertical haze occurs. The occurrence of this large vertical haze is prevented for the greater part by the construction of the first electrode. As appears from table I, the first electrode 14 is constructed from two plates 35 and 36 having square and rectangular apertures, respectively. As a result of this construction, a quadrupole lens field is generated at the area of the apertures in the first electrode 14 so that a cross-over which is oval in cross-section and has smaller vertical dimensions is obtained. As a result of this the vertical haze of the spot on the display screen is considerably reduced. It is to be noted that the use of quadrupole lens fields at the area of the first electrode is known per se from Netherlands Patent Applications 7712942 and 7712943, corresponding to U.K. patent application Nos. 2,008,851 and 2,008,850, respectively.

Figure 4A:
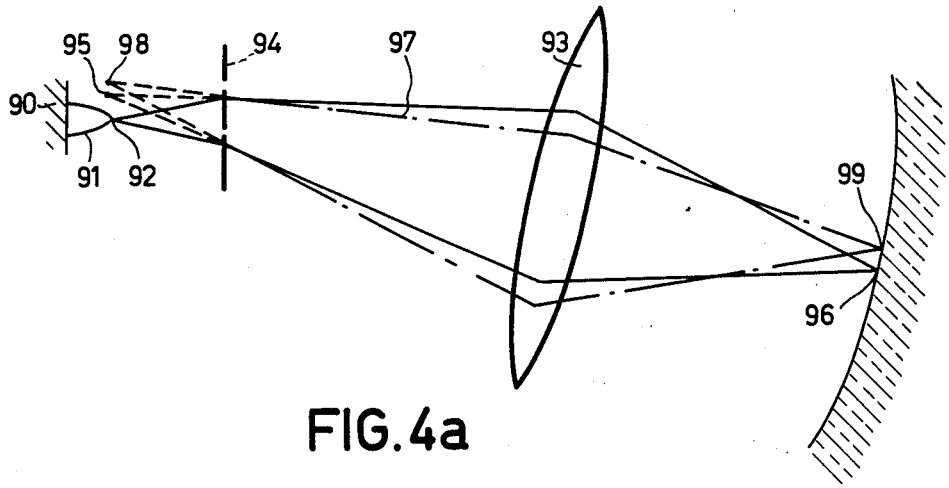

The principle of the invention will be explained once again with reference to FIGS. 4*a* and 4*b*. FIG. 4*a* shows diagrammatically the path of an outermost electron beam in a prior art electron gun. Of the electron beam 91 emitted by the cathode 90 a beam cross-over 92 is formed after which the beam diverges again. The electron beam 91 is deflected over the convergence angle between the second electrode and the first focusing electrode, denoted by the line 94. The electron beam 91 is then focused on the display screen in the point 96 by the focusing lens 93 shown diagrammatically. The point 95 is the virtual object point which is displayed on the display screen by the focusing lens 93. In the case of variations in the voltage at the second electrode or the first focusing electrode the electron beam is deflected over a different angle, which is denoted by the dot-and-dash line 97. The associated virtual object point 98 is shifted with respect to the original virtual object point 95. The virtual object point 98 is therefore displayed on the display screen by the focusing lens 93 in a point 99 which is displaced with respect to the original picture point 96. Voltage variations cause in this manner beam displacements on the display screen and consequently also convergence errors.

Figure 4B:
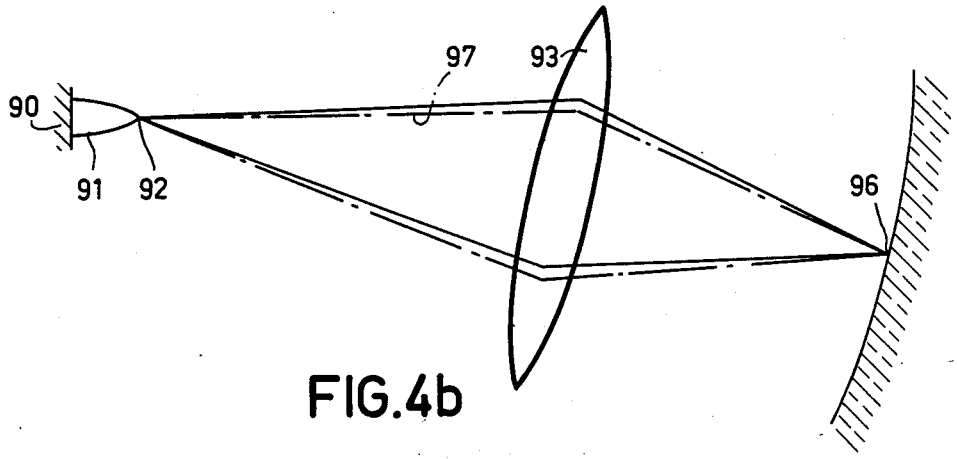

FIG. 4*b* shows diagrammatically the path of an outermost electron beam in an electron gun in accordance with the invention. The electron beam 91 is deflected over the convergence angle at the area of the cross-over 92 and is then focused on the display screen in the point 96 by the focusing lens 93 shown diagrammatically. The cross-over 92 is the object point which is displayed on the display screen by the focusing lens 93. In the case of variations in the voltage at the second electrode or the first focusing electrode, the electron beam 91 at the area of the cross-over 92 is deflected over a different angle, which is denoted by the dot-and-dash line 97. However, the cross-over 91 remains the object point which is displayed on the display screen by the focusing lens 93 so that the beam 97 is displayed in the same point 96. As a result of this only the angle varies at which the electron beam 97 impinges on the screen.

Figure 5:
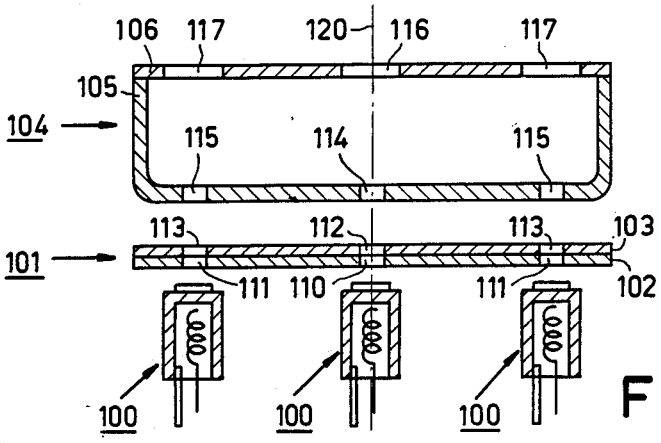
FIG. 5 is a sectional view of another embodiment of a triode part for an electron gun system according to the invention.

FIG. 5 shows another embodiment of a triode part of an electron gun system in accordance with the invention with which the outermost electron beams are deflected substantially at the area of the cross-over. The triode part again comprises three diagrammatically shown cathodes 100 and a first electrode 101 which is equal to the first electrode shown in FIG. 3. At a distance of 0.25 mm from the first electrode 101 a second electrode 104 is present. The second electrode 104 is formed by a beaker-shaped portion 105 the bottom portion of which is apertured. At the open end of the beaker-shaped portion 105 an apertured plate 106 is connected. The overall height of the second electrode 104 is 1.45 mm. In the table below are recorded the dimensions of the apertures in the first electrode 101 and the second electrode 104 with their distances to the axis 120 of the central electron beam.

| Electrode No | Thickness (mm) | Aperture No | Dimension (mm) | Distance axis to axis 120 (mm) |
|---|---|---|---|---|
| 101–102 | 0.10 | 110 | 0.7 × 0.7 | — |
| | | 111 | 0.7 × 0.7 | 9.90 |
| -103 | 0.20 | 112 | 0.7 × 2.1 | — |
| | | 113 | 0.7 × 2.1 | 9.90 |
| 104–105 | 0.25 | 114 | ϕ 0.7 | — |
| | | 115 | ϕ 0.7 | 9.95 |
| 106 | 0.40 | 116 | ϕ 3.0 | — |
| | | 117 | ϕ 3.0 | 9.75 |

As appears from the above table, the apertures 115 in the beaker-shaped portion 105 and the apertures 117 in the plate 106 for the two outermost electron beams are staggered with respect to the corresponding apertures in the first electrode 101. As a result of this, asymmetric lens fields are formed for the outermost electron beams at the area of the second electrode 104, which fields deflect the outermost electron beams towards the central electron beam in such manner that the three electron beams converge on the display screen. Since the outermost electron beams are deflected at the area of the cross-over, voltage variations of the second electrode 104 and the first focusing electrode cause no beam displacements on the display screen. The electron beams are focused on the display screen by means of a number of focusing electrodes, as shown in FIG. 3.

In addition to the embodiments shown, the invention may be used in any type of integrated electron gun system, for example, in those electron gun systems disclosed in U.S. Pat. Nos. 3,863,091 and 4,178,532.

What is claimed is:

1. A color display tube comprising an envelope containing a display screen and an electron gun system for producing in-line electron beams and for directing said beams toward said screen, said electron gun system including a triode part for producing the electron beams and focusing electrode means for focusing said beams at the screen, characterized in that said triode part comprises:

a. central and first and second outer cathodes for emitting electrons;

b. a first electrode disposed adjacent the cathodes and having central and first and second outer apertures for passing electrons emitted by the respective cathodes; and c. a second electrode including an apertured portion disposed opposite the first electrode;

said first electrode having its apertures dimensioned and arranged with respect to the cathodes to effect formation of the electrons emitted by the cathodes into two outer electron beams and one inner electron beam, each beam having a crossover occurring in the area of the apertured portion of the second electrode; and said second electrode portion having a central aperture dimensioned and arranged with respect to the central aperture in the first electrode for producing therebetween a localized electron field lens which effects passage of the central electron beam without deflection, and having first and second outer apertures, each being dimensioned and arranged eccentrically with respect to the corresponding aperture in the first electrode for producing therebetween a localized electron lens field which effects deflection of the respective electron beam, substantially in the area of the crossover, toward convergence with the inner electron beam at the screen.

2. A color display tube comprising an envelope containing a display screen and an electron gun system for producing in-line electron beams and for directing said beams toward said screen, said electron gun system including a triode part for producing the electron beams and focusing electrode means for focusing said beams at the screen, characterized in that said triode part comprises:

a. central and first and second outer cathodes for emitting electrons;

b. a first electrode disposed adjacent the cathodes and having central and first and second outer apertures for passing electrons emitted by the respective cathodes;

c. a second electrode including electrically connected, apertured, spaced-apart first and second electrode elements for passing the electrons from the apertures in the first electrode;

said first electrode having its apertures dimensioned and arranged with respect to the cathodes to effect formation of the electrons emitted by the cathodes into two outer electron beams and one inner electron beam, each beam having a crossover occurring in the area of the first electrode element;

said first electrode element being disposed opposite the first electrode, having a central aperture dimensioned and arranged with respect to the central aperture in the first electrode for producing therebetween a localized electron field lens which effects passage of the central electron beam without deflection, and having first and second outer apertures, each being dimensioned and arranged eccentrically with respect to the corresponding aperture in the first electrode for producing therebetween a localized electron lens field which effects deflection of the respective electron beam, substantially in the area of the crossover, toward convergence with the inner electron beam at the screen; and said second electrode element having a central aperture arranged symmetrically with respect to the central aperture in the first electrode element, and having first and second outer apertures, each being dimensioned and arranged eccentrically with respect to the corresponding aperture in the first electrode element.

3. A color display tube as in claim 2 where the second electrode comprises a beaker-shaped member having an open end and a closed end, a first plate member attached to an inner surface of the closed end and a second plate member attached to the open end, said closed end including central and first and second outer apertures which are disposed opposite and aligned with the apertures in the first electrode;

said first plate member forming the first electrode element and including said central and first and second outer apertures of said first electrode element; and said second plate member forming the second electrode element and including said central and first and second outer apertures of said second electrode element.

4. A color display tube as in claim 2 where the second electrode comprises a beaker-shaped member having an open end and a closed end, and a plate member attached to the open end;

said closed end forming the first electrode element and including said central and first and second outer apertures of said first electrode element; and said plate member forming the second electrode element and including said central and first and second outer apertures of said second electrode element.

5. A color display tube as in claim 1, 2, 3 or 4 where the focusing electrode means includes at least three focusing electrodes, each having respective openings for passing the inner electron beam and the deflected outer electron beams, the openings for the outer electron beams being situated such that said beams pass centrally therethrough.

6. A color display tube as in claim 5 where the successive focusing electrodes through which the electron beams pass have successively larger openings.

7. A color display tube comprising an envelope containing a display screen and an electron gun system for producing in-line electron beams and for directing said beams toward said screen, said electron gun system including a triode part for producing the electron beams and apertured focusing electrode means for focusing said beams at the screen, characterized in that said triode part comprises:

a. central and first and second outer cathodes for emitting electrons;

b. a first electrode disposed adjacent the cathodes and having central and first and second outer apertures for passing electrons emitted by the respective cathodes;

said first electrode having its apertures dimensioned and arranged with respect to the cathodes to effect formation of the electrons emitted by the cathodes into two outer electron beams and one inner electron beam; and c. a second electrode including at least one apertured portion having central and first and second outer apertures for passing the respective electron beams;

said second electrode having each of its outer apertures dimensioned and arranged with respect to the respective apertures in the first electrode and in the focusing electrode means to produce localized electron field lenses for effecting both crossover and convergence deflection of the respective outer electron beam in the area of said second electrode aperture.

* * * * *